US008888466B2

(12) United States Patent
Nemit, Jr.

(10) Patent No.: US 8,888,466 B2
(45) Date of Patent: Nov. 18, 2014

(54) COMPRESSOR

(75) Inventor: Paul Nemit, Jr., Waynesboro, PA (US)

(73) Assignee: Johnson Controls Technology Company, Holland, MI (US)

( * ) Notice: Subject to any disclaimer, the term of this patent is extended or adjusted under 35 U.S.C. 154(b) by 472 days.

(21) Appl. No.: 13/454,308

(22) Filed: Apr. 24, 2012

(65) Prior Publication Data

US 2012/0282129 A1 Nov. 8, 2012

Related U.S. Application Data

(60) Provisional application No. 61/482,885, filed on May 5, 2011.

(51) Int. Cl.
*F04C 28/12* (2006.01)
*F04C 18/16* (2006.01)

(52) U.S. Cl.
CPC ..... *F04C 18/16* (2013.01); *F04C 28/12* (2013.01)
USPC ..... 417/310; 417/410.4; 418/201.2

(58) Field of Classification Search
USPC ..... 418/180–181, 270, 201.1; 417/410.4, 417/213, 310, 440
See application file for complete search history.

(56) References Cited

U.S. PATENT DOCUMENTS

| | | | | | |
|---|---|---|---|---|---|
| 3,432,089 | A * | 3/1969 | Lauritz | ..... | 418/88 |
| 3,936,239 | A * | 2/1976 | Shaw | ..... | 417/315 |
| 4,222,716 | A * | 9/1980 | Shaw | ..... | 417/310 |
| RE31,379 | E * | 9/1983 | Shaw | ..... | 417/310 |
| 5,018,948 | A * | 5/1991 | Sjte et al. | ..... | 417/302 |
| 6,082,985 | A * | 7/2000 | Suzuki et al. | ..... | 418/201.2 |
| 7,588,430 | B2 * | 9/2009 | Hasegawa | ..... | 418/201.1 |

FOREIGN PATENT DOCUMENTS

| | | |
|---|---|---|
| WO | 2004/053334 A1 | 6/2004 |
| WO | 2010/111685 A2 | 9/2010 |

* cited by examiner

*Primary Examiner* — Bryan Lettman
(74) *Attorney, Agent, or Firm* — McNees Wallace & Nurick LLC

(57) ABSTRACT

A compressor including a compression mechanism configured and positioned to receive vapor from an intake passage and provide compressed vapor to a discharge passage. An opening is positioned in the compression mechanism in fluid communication with the discharge passage. A valve has an aperture formed therein, the aperture configured and positioned in fluid communication with a passageway to provide a path for a pressurized vapor flow to a first chamber and a first piston without mixing with vapor in the discharge passage. A second chamber is in fluid communication with a second piston and the discharge passage, the first piston and the second piston of the valve configured to move together. First piston and second piston movement are controllable in response to predetermined conditions to maintain the magnitude of pressure of the compression mechanism immediately upstream of the opening at substantially the same pressure magnitude at the discharge passage.

20 Claims, 7 Drawing Sheets

COMPRESSOR

CROSS-REFERENCE TO RELATED APPLICATIONS

This application claims priority from and the benefit of U.S. Provisional Application No. 61/482,885, entitled COMPRESSOR, filed May 5, 2011, which is hereby incorporated by reference.

BACKGROUND

The application generally relates to positive-displacement compressors. The application relates more specifically to controlling the volume ratio of a screw compressor.

In a rotary screw compressor, intake and compression can be accomplished by two tightly-meshing, rotating, helically lobed rotors that alternately draw gas into the threads and compress the gas to a higher pressure. The screw compressor is a positive displacement device with intake and compression cycles similar to a piston/reciprocating compressor. The rotors of the screw compressor can be housed within tightly fitting bores that have built in geometric features that define the inlet and discharge volumes of the compressor to provide for a built in volume ratio of the compressor. The volume ratio of the compressor should be matched to the volume ratio of the system in which the compressor is incorporated, thereby avoiding over or under compression, and the resulting lost work. In a closed loop refrigeration system, the volume ratio of the system is established in the hot and cold side heat exchangers.

Fixed volume ratio compressors can be used to avoid the cost and complication of variable volume ratio machines. A screw compressor having fixed inlet and discharge openings or ports built into the housings can be optimized for a specific set of suction and discharge conditions/pressures. However, the system in which the compressor is connected rarely operates at exactly the same conditions hour to hour, especially in an air conditioning application. Nighttime, daytime, and seasonal temperatures can affect the volume ratio of the system and the efficiency with which the compressor operates. In a system where the load varies, the amount of heat being rejected in the condenser fluctuates, causing the high side pressure to rise or fall, resulting in a volume ratio for the compressor that deviates from the compressor's optimum volume ratio.

For example, a refrigeration system can include a compressor, condenser, expansion device, and evaporator. The efficiency of the compressor is related to the saturated conditions within the evaporator and condenser. The pressure in the condenser and evaporator can be used to establish the pressure ratio of the system external to the compressor. In the current example, the pressure ratio/compression ratio can be 4. The volume ratio or Vi is linked to the compression ratio by the relation of the compressor ratio Cr raised to the power of 1/k; k being the ratio of specific heat of the gas or refrigerant being compressed. Using the previous relation, the volume ratio to be built into the compressor geometry for the current example is 3.23 for optimum performance at full load conditions. However, during part load, low ambient conditions, or nighttime, the saturated condition of the condenser in the refrigeration system decreases while evaporator conditions remain relatively constant. To maintain optimum performance of the compressor at part load or low ambient conditions, the Vi for the compressor should be lowered to 2.5.

Therefore, what is needed is a system to automatically vary the volume ratio of the compressor at part load or low ambient conditions without using costly and complicated control systems.

SUMMARY

An embodiment of the present application is a compressor including a compression mechanism, the compression mechanism being configured and positioned to receive vapor from an intake passage and provide compressed vapor to a discharge passage. An opening is positioned in the compression mechanism in fluid communication with the discharge passage. A valve has an aperture formed therein, the aperture configured and positioned in fluid communication with a passageway to provide a path for a pressurized vapor flow to a first chamber and a first piston without mixing with vapor in the discharge passage. A second chamber is in fluid communication with a second piston and the discharge passage, the first piston and the second piston of the valve configured to move together. Movement of the first piston and second piston being controllable in response to predetermined conditions to maintain the magnitude of pressure of the compression mechanism immediately upstream of the opening at substantially the same pressure magnitude at the discharge passage.

A further embodiment of the present application is a screw compressor including an intake passage to receive vapor and the discharge passage to supply of vapor. A pair of intermeshing rotors, each rotor of the pair of intermeshing rotors is positioned in the corresponding cylinder. The pair of intermeshing rollers is configured to receive vapor from the intake passage and provide compressed vapor to the discharge passage. An opening is positioned in at least one rotor cylinder in fluid communication with the discharge passage. A valve has an aperture formed therein. The aperture is configured and positioned in fluid communication with a passageway to provide a path for a pressurized vapor flow to a first chamber and a first piston without mixing with vapor in the discharge passage. A second chamber is in fluid communication with a second piston and the discharge passage, the first piston and the second piston of the valve configured to move together. Movement of the first piston and second piston are controllable in response to predetermined conditions to maintain the magnitude of pressure of the pair of intermeshing rotors immediately upstream of the opening at substantially the same pressure magnitude at the discharge passage.

One advantage of the present application is a system that has an automatically adjustable slide valve to provide an improved energy efficiency rating (EER) over a fixed volume ratio compressor.

BRIEF DESCRIPTION OF THE EXEMPLARY EMBODIMENTS

Figure 1:
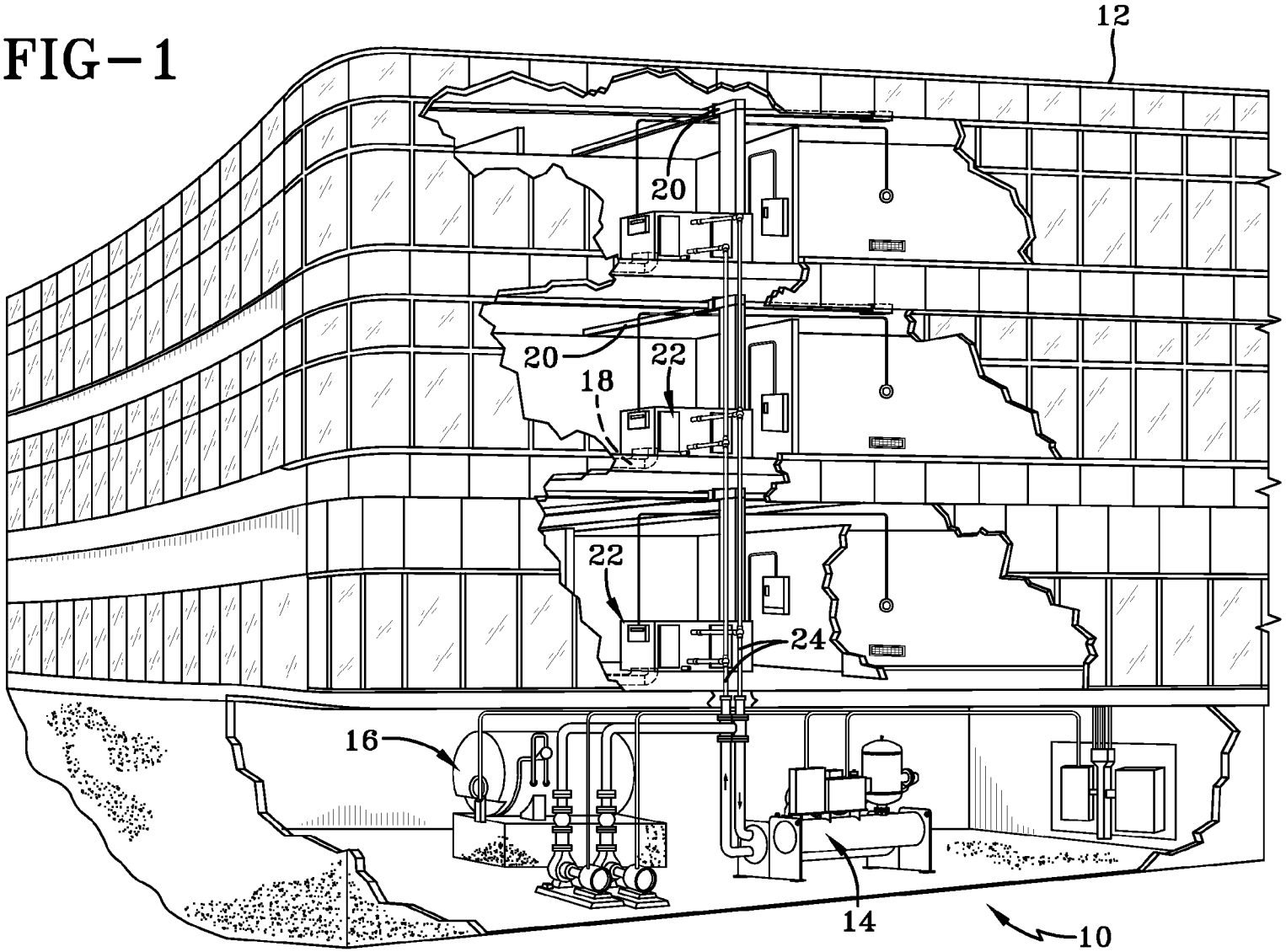
FIG. 1 shows an exemplary embodiment for a heating, ventilation and air conditioning system.

FIG. 1 shows an exemplary environment for a heating, ventilation and air conditioning (HVAC) system 10 in a building 12 for a typical commercial setting. System 10 can include a vapor compression system 14 that can supply a chilled liquid which may be used to cool building 12. System 10 can include a boiler 16 to supply heated liquid that may be used to heat building 12, and an air distribution system which circulates air through building 12. The air distribution system can also include an air return duct 18, an air supply duct 20 and an air handler 22. Air handler 22 can include a heat exchanger that is connected to boiler 16 and vapor compression system 14 by conduits 24. The heat exchanger in air handler 22 may receive either heated liquid from boiler 16 or chilled liquid from vapor compression system 14, depending on the mode of operation of system 10. System 10 is shown with a separate air handler on each floor of building 12, but it is appreciated that the components may be shared between or among floors.

Figure 2:
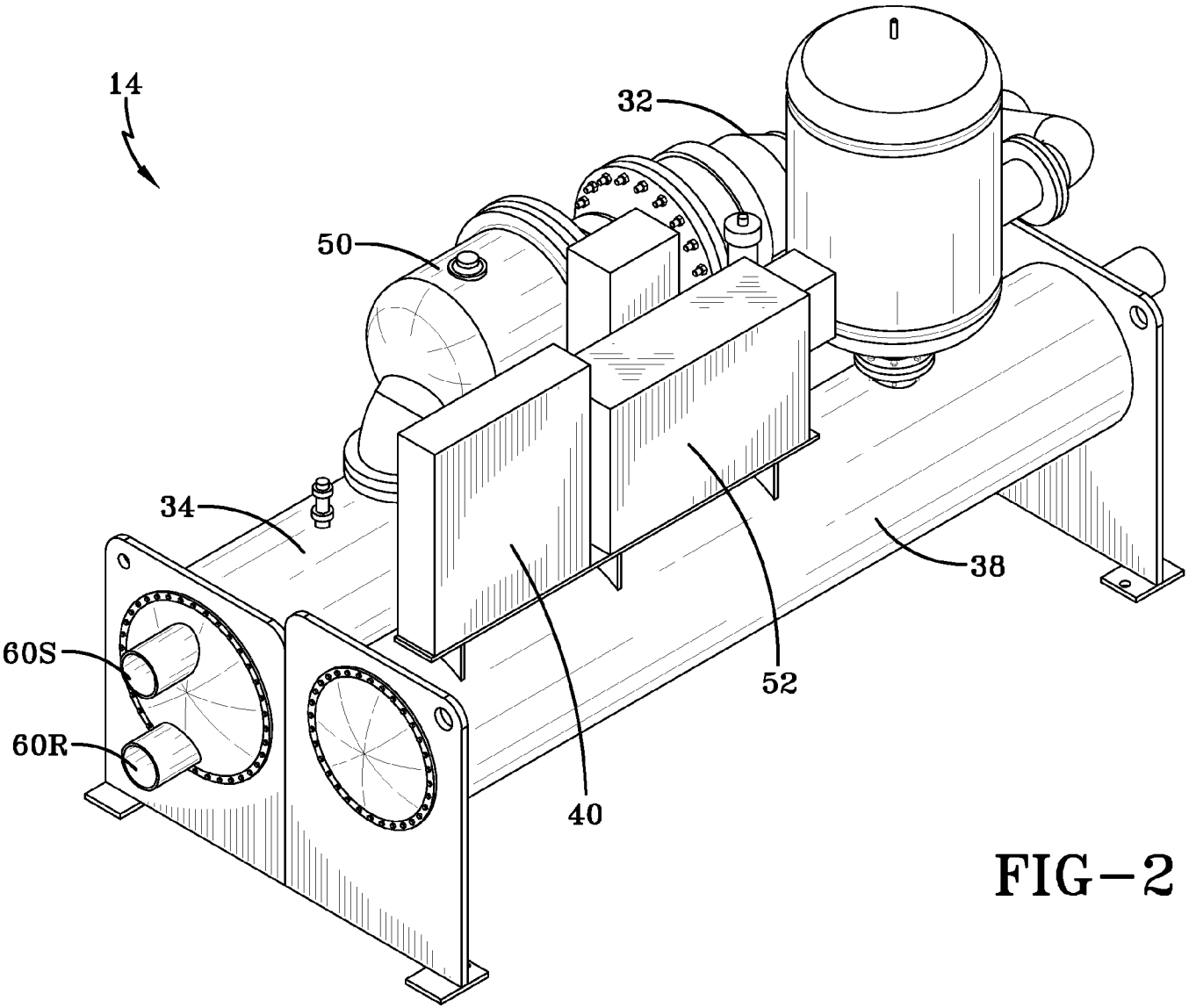
FIG. 2 shows an isometric view of an exemplary vapor compression system.
Figure 3:
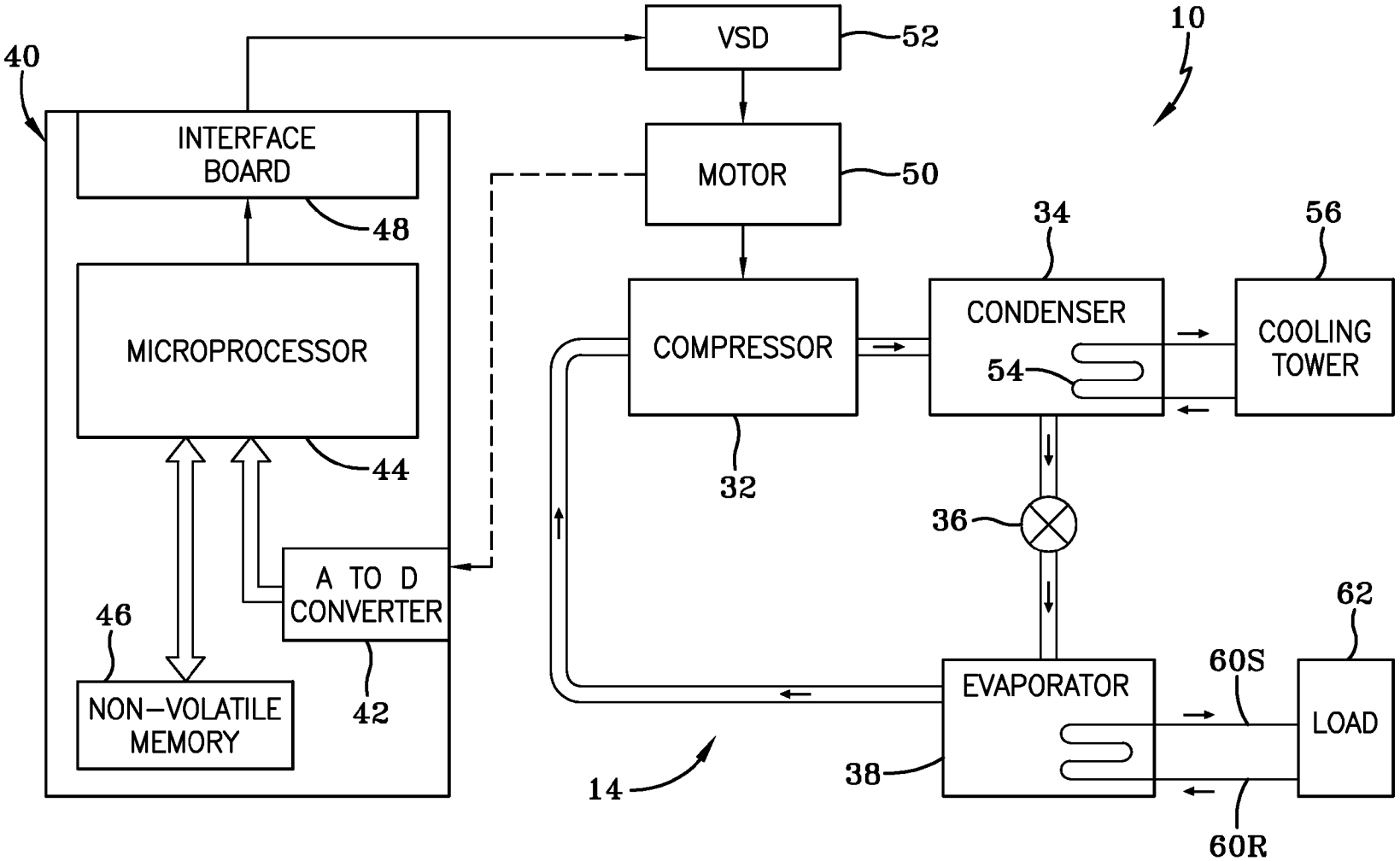
FIGS. 3 and 4 schematically show exemplary embodiments of a vapor compression system.

FIGS. 2 and 3 show an exemplary vapor compression system 14 that can be used in HVAC system 10. Vapor compression system 14 can circulate a refrigerant through a circuit starting with compressor 32 and including a condenser 34, expansion valve(s) or device(s) 36, and an evaporator or liquid chiller 38. Vapor compression system 14 can also include a control panel 40 that can include an analog to digital (A/D) converter 42, a microprocessor 44, a non-volatile memory 46, and an interface board 48. Some examples of fluids that may be used as refrigerants in vapor compression system 14 are hydrofluorocarbon (HFC) based refrigerants, for example, R-410A, R-407, R-134a, hydrofluoro olefin (HFO), "natural" refrigerants like ammonia ($NH_3$), R-717, carbon dioxide ($CO_2$), R-744, or hydrocarbon based refrigerants, water vapor or any other suitable type of refrigerant. In an exemplary embodiment, vapor compression system 14 may use one or more of each of variable speed drives (VSDs) 52, motors 50, compressors 32, condensers 34, expansion valves 36 and/or evaporators 38.

Motor 50 used with compressor 32 can be powered by a variable speed drive (VSD) 52 or can be powered directly from an alternating current (AC) or direct current (DC) power source. VSD 52, if used, receives AC power having a particular fixed line voltage and fixed line frequency from the AC power source and provides power having a variable voltage and frequency to motor 50. Motor 50 can include any type of electric motor that can be powered by a VSD or directly from an AC or DC power source. Motor 50 can be any other suitable motor type, for example, a switched reluctance motor, an induction motor, or an electronically commutated permanent magnet motor. In an alternate exemplary embodiment, other drive mechanisms such as steam or gas turbines or engines and associated components can be used to drive compressor 32.

Compressor 32 compresses a refrigerant vapor and delivers the vapor to condenser 34 through a discharge passage. Compressor 32 can be a screw compressor in one exemplary embodiment. The refrigerant vapor delivered by compressor 32 to condenser 34 transfers heat to a fluid, for example, water or air. The refrigerant vapor condenses to a refrigerant liquid in condenser 34 as a result of the heat transfer with the fluid. The liquid refrigerant from condenser 34 flows through expansion device 36 to evaporator 38. In the exemplary embodiment shown in FIG. 3, condenser 34 is water cooled and includes a tube bundle 54 connected to a cooling tower 56.

The liquid refrigerant delivered to evaporator 38 absorbs heat from another fluid, which may or may not be the same type of fluid used for condenser 34, and undergoes a phase change to a refrigerant vapor. In the exemplary embodiment shown in FIG. 3, evaporator 38 includes a tube bundle having a supply line 60S and a return line 60R connected to a cooling load 62. A process fluid, for example, water, ethylene glycol, calcium chloride brine, sodium chloride brine, or any other suitable liquid, enters evaporator 38 via return line 60R and exits evaporator 38 via supply line 60S. Evaporator 38 chills the temperature of the process fluid in the tubes. The tube bundle in evaporator 38 can include a plurality of tubes and a plurality of tube bundles. The vapor refrigerant exits evaporator 38 and returns to compressor 32 by a suction line to complete the cycle.

Figure 4:
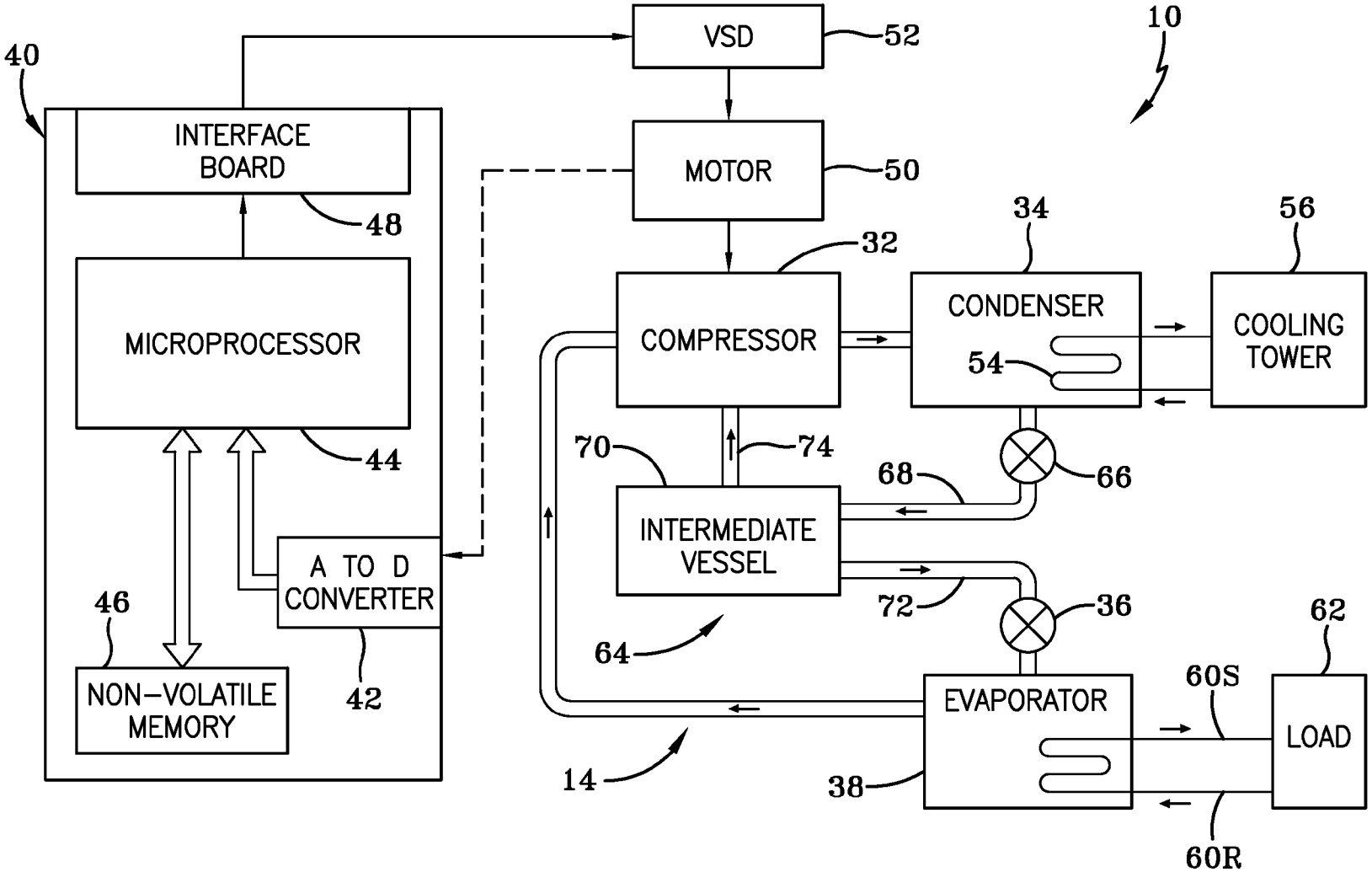

FIG. 4, which is similar to FIG. 3, shows the vapor compression system 14 with an intermediate circuit 64 incorporated between condenser 34 and expansion device 36. Intermediate circuit 64 has an inlet line 68 that can be either connected directly to or can be in fluid communication with condenser 34. As shown, inlet line 68 includes an expansion device 66 positioned upstream of an intermediate vessel 70. Intermediate vessel 70 can be a flash tank, also referred to as a flash intercooler, in an exemplary embodiment. In an alternate exemplary embodiment, intermediate vessel 70 can be configured as a heat exchanger or a "surface economizer." In the configuration shown in FIG. 4, i.e., the intermediate vessel 70 is used as a flash tank, a first expansion device 66 operates to lower the pressure of the liquid received from condenser 34. During the expansion process, a portion of the liquid vaporizes. Intermediate vessel 70 may be used to separate the vapor from the liquid received from first expansion device 66 and may also permit further expansion of the liquid. The vapor may be drawn by compressor 32 from intermediate vessel 70 through a line 74 to the suction inlet, a port or opening at a pressure intermediate between suction and discharge or an intermediate stage of compression. The liquid that collects in the intermediate vessel 70 is at a lower enthalpy from the expansion process. The liquid from intermediate vessel 70 flows in line 72 through a second expansion device 36 to evaporator 38.

In an exemplary embodiment, compressor 32 can include a compressor housing that contains the working parts of compressor 32. Vapor from evaporator 38 can be directed to an intake passage of compressor 32. Compressor 32 compresses the vapor with a compression mechanism and delivers the compressed vapor to condenser 34 through a discharge passage. Motor 50 may be connected to the compression mechanism of compressor 32 by a drive shaft.

Vapor flows from the intake passage of compressor 32 and enters a compression pocket of the compression mechanism. The compression pocket is reduced in size by the operation of the compression mechanism to compress the vapor. The compressed vapor can be discharged into the discharge passage. For example, for a screw compressor, the compression pocket is defined between the surfaces of the rotors of the compressor. As the rotors of the compressor engage one another, the compression pockets between the rotors of the compressor, also referred to as lobes, are reduced in size and are axially displaced to a discharge side of the compressor.

As the vapor travels in the compression pocket, a valve or valve body, such as a slide valve, can be positioned in a bore formed in the compression mechanism, such as a cylinder securing intermeshing rotors of a screw compressor, in close proximity to or prior to the discharge end. An aperture is formed in the slide valve and positioned at an intermediate point in the compression mechanism related to the discharge passage. That is, the aperture formed in the slide valve is spaced from the discharge end and can be used to provide a passageway having a reference flow path and a reduced pressure to a chamber that is in close proximity to, but isolated from the discharge end maintained at the system discharge pressure of the compressor. In an exemplary embodiment, the position of the slide valve can be controlled by automatically balancing forces applied to the slide valve by use of the reference flow path, such that the pressure associated with the discharge end of the rotor housing is substantially the same as the system pressure required at a given moment to provide the amount of heating or cooling required by the system, resulting in optimum operating efficiencies of compressor 32. That is, by virtue of the reference flow path, the slide valve will be positioned so that the discharge pressure from the rotors will be maintained at a level that is substantially the same as the discharge pressure of the system.

Figure 5:
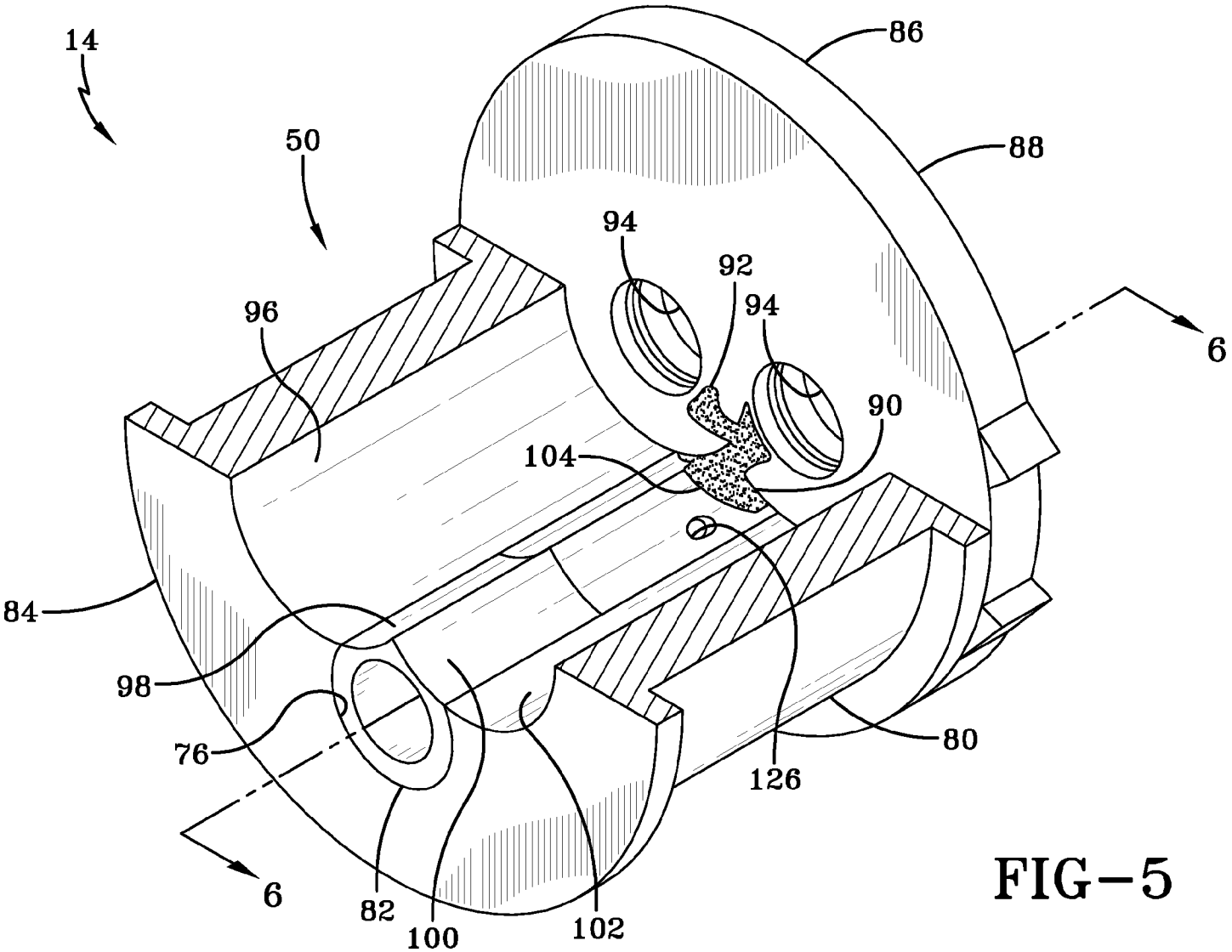
FIG. 5 shows a partial cut-away view of a compressor having an exemplary embodiment of a volume ratio control system.
Figure 6:
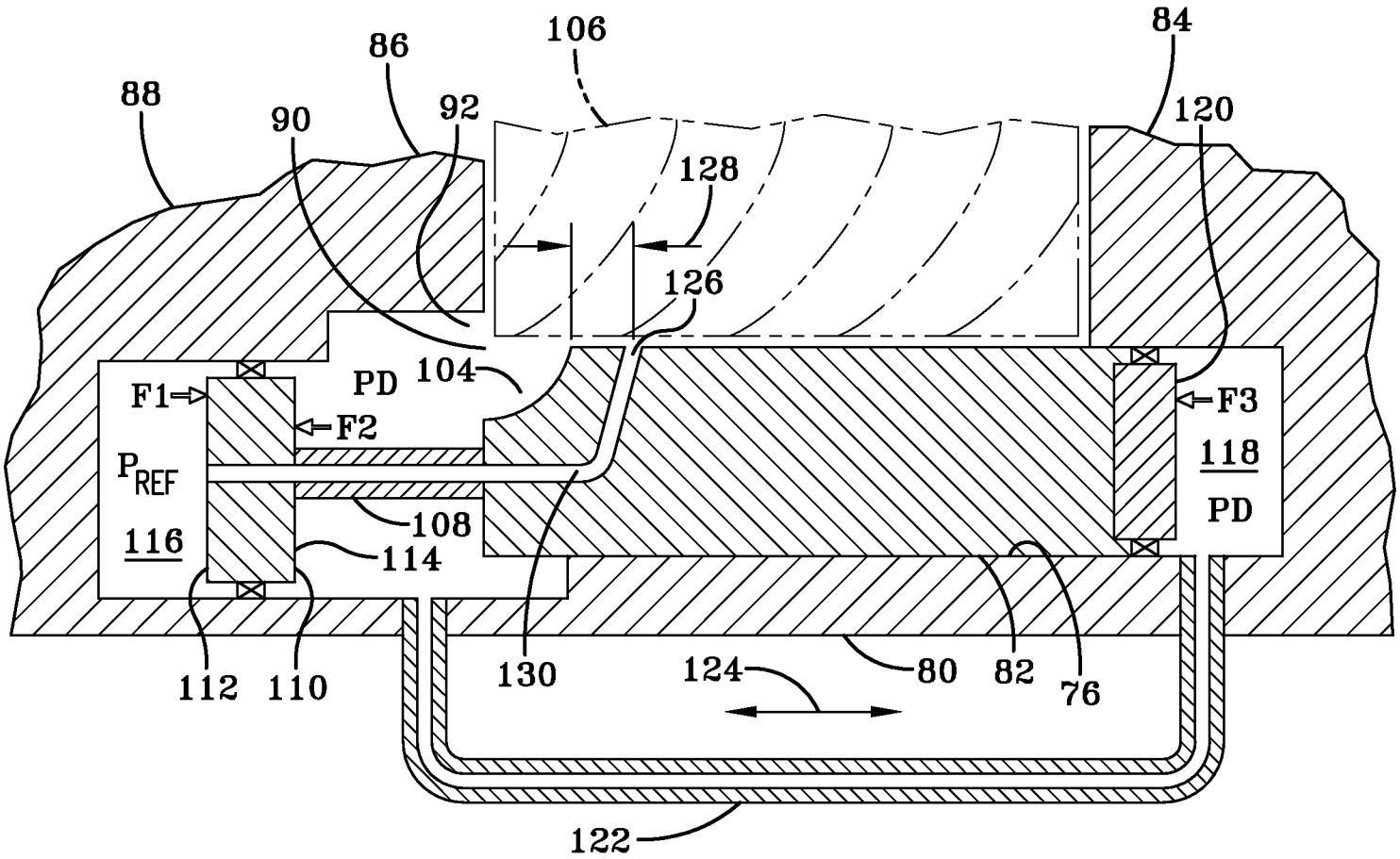
FIG. 6 shows a cross section taken along line 6-6 of FIG. 5.

As shown in FIGS. 5-6, compressor 32 of the vapor compression system 14 includes a rotor housing or housing 80 comprising a discharge housing 88 having openings 94 within each of which opening, one end of engaged rotor lobes (not shown) rotate. Surface 96 of rotor housing or housing 80 and surface 98 of slide valve 82 correspond to the lower portion of surfaces associated with one rotor, while surface 102 of rotor housing or housing 80 and surface 100 of slide valve 82 correspond to the lower portion of surfaces associated with the other rotor. Operation of an exemplary screw compressor and associated components are disclosed in Applicant's pending Application No. PCT/US2010/028966, titled "Compressor", which is incorporated by reference in its entirety. Rotor housing or housing 80 abuts a discharge housing 88 at a discharge end 86. Rotor housing or housing 80 further includes a bore 76 for receiving a slide valve 82 substantially positioned and configured to slideably move between an intake end 84 of rotor housing or housing 80 and discharge end 86 of discharge housing 88. In one embodiment, bore 76 is positioned in compressor housing 80 substantially parallel to a flow of vapor in the compressor housing 80. Stated another way, bore 76 is positioned in the compression mechanism substantially parallel to a flow of vapor in the compression mechanism. An opening 90 is formed along the junction of rotor housing 80 and discharge housing 88, opening 90 including a discharge opening portion 92 formed in and associated with discharge housing 88 and a discharge opening portion 104 formed in and associated with slide valve 82. Discharge opening 90 permits a portion of slide valve 82 to extend therethrough past discharge end 86 of the compressor. Discharge opening portion 104 formed in slide valve 82 defines a recess, permitting enhanced fluid communication between discharge opening portion 92 leading to the condenser and the rotor discharge pressure. Since the system (condenser) pressure is the prominent pressure compared to the rotor discharge pressure, once the rotor discharge reaches opening 90, the pressure level equalizes and is referred to as the discharge pressure or PD.

Figure 7:
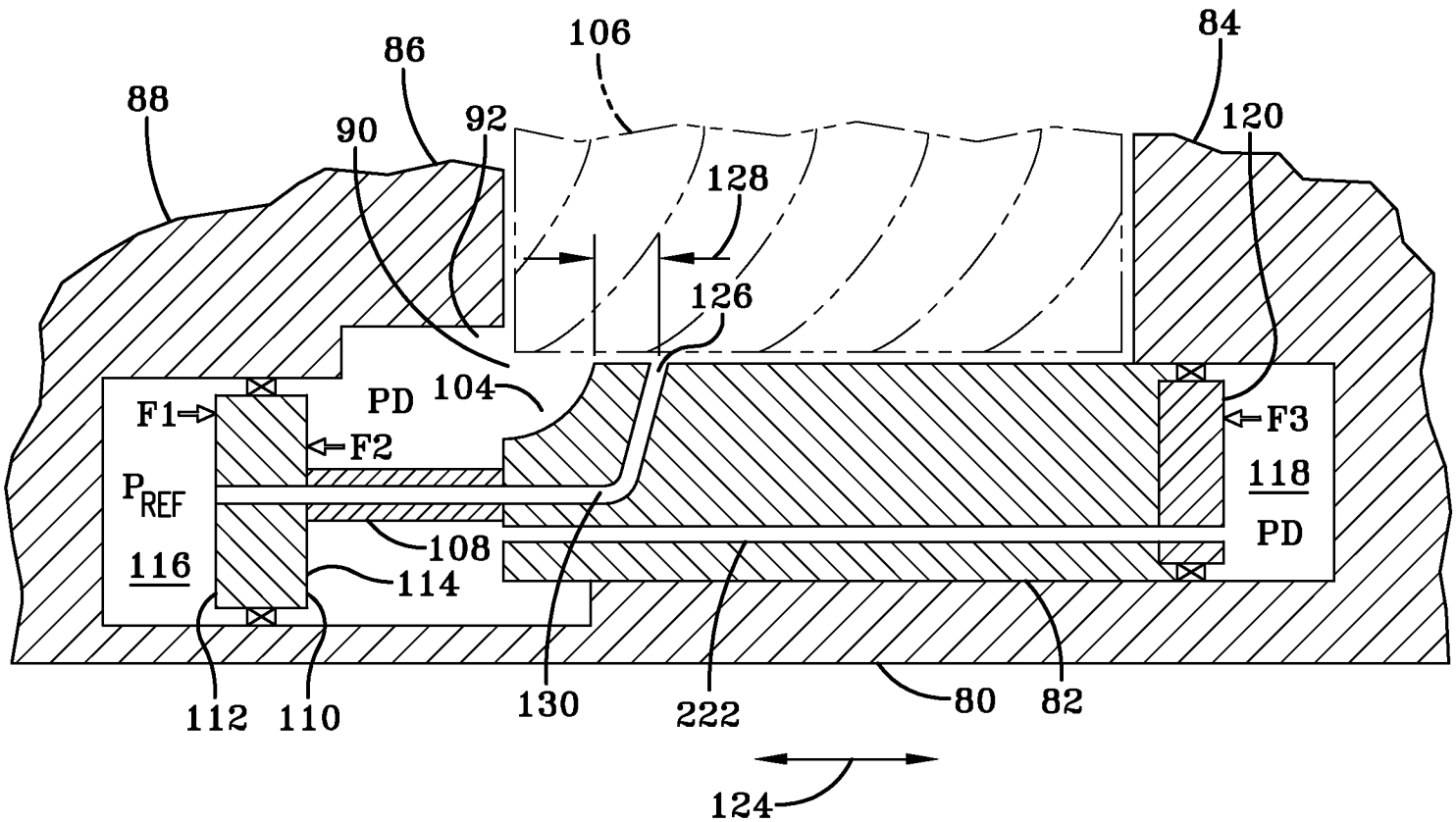
FIG. 7 shows a cross section taken along line 6-6 of FIG. 5 of an alternate embodiment of the system.

As further shown in FIG. 6, slide valve 82 extends from the discharge end 86 via extension 108 to a first piston 110 having a first surface area or first area 112 facing a first chamber 116. First piston 110 has an opposed second surface area or second area 114 facing opening 90 in the compression mechanism. First chamber 116 is maintained at a pressure designated as a reference pressure or PREF. Reference pressure PREF corresponds to a pressure level that is less than discharge pressure PD, by virtue of a spacing 128 between discharge opening portion 92 and an aperture 126 formed in slide valve 82 adjacent to compression mechanism or rotor 106 (shown in phantom line). The magnitude of spacing 128 is dependent on other relationships that result in offsetting forces that are used to determine the position slide valve 82. That is, reference pressure PREF in fluid communication with aperture 126 which is maintained in fluid communication with passageway 130, extends through extension 108 and interconnects the body of slide valve 82 and first piston 110, providing a path for a pressurized vapor flow to a first chamber 116 and first piston 110. Reference pressure PREF is maintained in first chamber 116 facing first area 112 of first piston 110. As a result, reference pressure PREF multiplied by first area 112 of first piston 110 generates a force F1 that urges first piston 110 (and therefore slide valve 82) toward opening 90. An opposing force F2 is generated along a second area 114 of first piston (equal to first area 112 from which is subtracted the cross sectional area of extension 108 contacting second area 114) multiplied by discharge pressure PD. Due to an equalizing line 122, second chamber 118, which includes a second piston 120, is in fluid communication with the discharge region or discharge passageway that is maintained at the discharge pressure PD. A force F3 is generated as a result of the surface area of second piston 120 multiplied by discharge pressure PD, urging second piston 120 toward opening 90. In an alternate embodiment, as shown in FIG. 7, an equalizing line 222 may be formed in the body of the slide valve in place of equalizing line 122. In a further embodiment, both equalizing lines 122, 222 may be used.

When properly configured, the rotor discharge pressure (the magnitude of rotor pressure in the rotor housing immediately prior to reaching opening 104) is substantially equal to the system discharge pressure PD (positioned in fluid communication with opening 90). The equalization between the rotor discharge pressure and the system discharge pressure PD is achieved via a balancing of forces F1, F2 and F3. In other words, the magnitude of spacing 128 (which establishes reference pressure PREF), in combination with the relative sizes of the surface areas of the first and second pistons, are sized to achieve movement of the slide valve along travel direction 124 to maintain substantial equilibrium between the rotor discharge pressure and the system discharge pressure. By virtue of such equilibrium, compressor efficiency is maximized.

It is to be understood that movement of first piston 110 and second piston 120 are controllable in response to predetermined conditions corresponding to operating conditions or parameters to which a compressor of the present disclosure is subjected. Operating parameters of the compressor include, but are not limited to time of day of operation of the compressor, ambient conditions surrounding the compressor, operating load of the compressor, and other conditions/parameters.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A compressor comprising:

a compression mechanism, the compression mechanism being configured and positioned to receive vapor from an intake passage and provide compressed vapor to a discharge passage;

an opening positioned in the compression mechanism in fluid communication with the discharge passage;

a valve having an aperture formed therein, the aperture configured and positioned in fluid communication with a passageway to provide a path for a pressurized vapor to flow into a first chamber and in contact with a first piston therein without mixing with vapor in the discharge passage;

a second chamber in fluid communication with a second piston and the discharge passage, the first piston and the second piston of the valve configured to move together; and movement of the first piston and second piston being controllable in response to predetermined conditions to maintain the magnitude of pressure of the compression mechanism immediately upstream of the opening at substantially the same pressure magnitude as is in the discharge passage.

2. The compressor of claim 1, wherein the compression mechanism comprises rotors that engage one another.

3. The compressor of claim 1, wherein the valve comprises a valve body slideably movable in a bore.

4. The compressor of claim 3, wherein the valve body is movable in the bore in response to a difference in forces applied to the first piston and the second piston of the valve body.

5. The compressor of claim 3, wherein the bore is positioned in the compression mechanism substantially parallel to a flow of vapor in the compression mechanism.

6. The compressor of claim 3, wherein the first piston has a first surface area and an opposed second surface area, and the second piston has a surface area facing the second chamber.

7. The compressor of claim 6, wherein:

a reference pressure is provided through the aperture and passageway formed in the valve body in fluid communication with the first chamber facing the first surface area of the first piston, thereby generating a force urging the first piston toward the opening in the compression mechanism;

a discharge pressure faces the second surface area of the first piston, thereby generating a force urging the first piston away from the opening in the compression mechanism; and the discharge pressure in the second chamber in fluid communication with the surface area of the second piston, thereby generating a force urging the second piston toward the opening in the compression mechanism.

8. The compressor of claim 7, including an equalizing line in fluid communication between the discharge passage and the second chamber.

9. The compressor of claim 8, wherein equalizing line is formed in the valve body.

10. The compressor of claim 7, wherein the reference pressure is less than the discharge pressure.

11. The compressor of claim 10, wherein the reference pressure corresponds to the aperture and passageway formed in the valve body, there being a spacing between the aperture and a discharge opening portion formed in the valve body.

12. The compressor of claim 11, wherein the discharge opening portion defines a recess formed in the valve body.

13. The compressor of claim 1, wherein the predetermined conditions correspond to operating parameters of the compressor.

14. The compressor of claim 13, wherein the operating parameters of the compressor include time of day of operation of the compressor, ambient conditions surrounding the compressor and load.

15. A screw compressor comprising:

an intake passage to receive vapor and a discharge passage to supply vapor;

a pair of intermeshing rotors, each rotor of the pair of intermeshing rotors being positioned in a corresponding cylinder, the pair of intermeshing rollers being configured to receive vapor from the intake passage and provide compressed vapor to the discharge passage;

an opening positioned in at least one rotor cylinder in fluid communication with the discharge passage;

a valve having an aperture formed therein, the aperture configured and positioned in fluid communication with a passageway to provide a path for a pressurized vapor to flow into a first chamber and in contact with a first piston therein without mixing with vapor in the discharge passage;

a second chamber in fluid communication with a second piston and the discharge passage, the first piston and the second piston of the valve configured to move together; and movement of the first piston and second piston being controllable in response to predetermined conditions to maintain the magnitude of pressure of the pair of intermeshing rotors immediately upstream of the opening at substantially the same pressure magnitude as is in the discharge passage.

16. The screw compressor of claim 15, wherein the valve comprises a valve body slideably movable in a bore.

17. The screw compressor of claim 16, wherein the valve body is movable in the bore in response to a difference in forces applied to the first piston and the second piston of the valve body.

18. The screw compressor of claim 16, wherein:

the first piston has a first surface area and an opposed second surface area, and the second piston has a surface area facing the second chamber;

a reference pressure is provided through the aperture and passageway formed in the valve body in fluid communication with the first chamber facing the first surface area of the first piston, thereby generating a force urging the first piston toward the opening in the at least one rotor cylinder;

a discharge pressure faces the second surface area of the first piston, thereby generating a force urging the first piston away from the opening in the at least one rotor cylinder; and the discharge pressure in the second chamber in fluid communication with the surface area of the second piston, thereby generating a force urging the second piston toward the opening in the at least one rotor cylinder.

19. The screw compressor of claim 18, including an equalizing line in fluid communication between the discharge passage and the second chamber.

20. The screw compressor of claim 18, wherein the reference pressure is less than the discharge pressure, the reference pressure corresponding to the aperture and passageway formed in the valve body, there being a spacing between the aperture and a discharge opening portion formed in the valve body.

* * * * *